US005605529A

United States Patent [19]

Petithory

[11] Patent Number: 5,605,529

[45] Date of Patent: Feb. 25, 1997

[54] HIGH EFFICIENCY CENTRIFUGE ROTOR

[75] Inventor: Henry Petithory, Fayville, Mass.

[73] Assignee: Norfolk Scientific, Inc., Norwood, Mass.

[21] Appl. No.: 587,608

[22] Filed: Jan. 17, 1996

[51] Int. Cl.[6] ..... B04B 5/02

[52] U.S. Cl. ..... 494/16; 494/43

[58] Field of Search ..... 494/16, 17, 18, 494/19, 21, 43, 60, 49, 81, 72; 422/72; 210/360.1, 781, 782

[56] References Cited

U.S. PATENT DOCUMENTS

| | | | |
|---|---|---|---|
| 4,221,324 | 9/1980 | Frey | 233/26 |
| 4,306,676 | 12/1981 | Edwards et al. | 233/26 |
| 4,449,964 | 5/1984 | Westberg et al. | 494/16 |
| 4,509,940 | 4/1985 | Romanauskas | 494/16 |
| 4,553,955 | 11/1985 | Lam et al. | 494/16 |
| 4,738,655 | 4/1988 | Brimhall et al. | 494/10 |
| 4,776,832 | 10/1988 | Martin et al. | 494/19 |
| 4,820,257 | 4/1989 | Ishimaru | 494/16 |
| 4,824,429 | 4/1989 | Keunen et al. | 494/16 |
| 5,024,646 | 6/1991 | Lewis et al. | 494/16 |
| 5,318,748 | 6/1994 | Babson et al. | 422/72 |
| 5,344,380 | 9/1994 | Chern et al. | 494/16 |
| 5,354,254 | 10/1994 | Zabriskie et al. | 494/12 |

*Primary Examiner*—Robert W. Jenkins

*Attorney, Agent, or Firm*—Weingarten, Schurgin, Gagnebin & Hayes LLP

[57] ABSTRACT

A high efficiency centrifuge rotor for rapid separation of particles suspended in a liquid is disclosed. The rotor features one or more cavities disposed at a compound angle to provide for rapid separation of particles suspended in a liquid while minimizing distortion of the separation interface or separation barrier, if any, within the sample container.

17 Claims, 6 Drawing Sheets

Max r = 5.3 cm

HIGH EFFICIENCY CENTRIFUGE ROTOR

FIELD OF THE INVENTION

The invention relates generally to centrifuge rotors, and more particularly to fixed angle centrifuge rotors.

BACKGROUND OF THE INVENTION

Most blood chemistry tests require preparation of serum or plasma prior to analysis. To this end, red blood cells and other cellular material are separated from the patient's blood following collection. Typically, blood is collected in evacuated tubes and centrifuged at 2000–3000 rpm for 10–20 minutes.

One type of centrifuge rotor which houses tubes for centrifugation is a fixed angle rotor, in which the tubes are retained in cavities angled relative to the axis of rotation. The dynamics of fixed angle rotors and their ability to enhance the speed of centrifugation are known in the art. The clearing efficiency (K-factor) of fixed angle rotors, which corresponds to the time required to sediment a specific particle in a known medium at a given speed of rotation, can be calculated using the following formula:

$$K\text{-factor} = \frac{2.53 \times 10^{11} \times \mathrm{Ln}\left(\frac{r_1}{r_2}\right)}{N^2}$$

where $r_1$=radius, in cm, from the outermost point of liquid in the tube to the central axis of rotation, $r_2$=radius, in cm, from the center of the top of liquid within the tube to the central axis of rotation and N=rpm.

It is apparent from the above formula that a rotor having tube cavities inclined at a steep angle (approaching 0° in reference to the axis of rotation) can provide the lowest K-factor, and the greatest separation efficiency. However, there are drawbacks associated with using a rotor having steeply angled tube cavities including the fact that the steeper the angle, the greater the tendency of particles to adhere to the outermost wall of the tube, which could lead to contamination of the supernatant.

Another drawback is that the sedimentation boundary formed in a fixed angle rotor centrifuge device is significantly larger than the sedimentation boundary formed in centrifuges using a swing-out style rotor.

Another disadvantage of a steeply angled rotor occurs when gel barrier tubes are used. The position of the gel band along the top side-wall of the processed tube makes it difficult to pipette the supernatant plasma or serum without coming into contact with the gel material. This is especially important in analyzers which employ primary tube sampling capability. Since the thickness of the gel band decreases with the relative steepness of the tube angle, the band can collapse upon deceleration and cause contamination of the supernatant with the particles in the gel.

Still another disadvantage is that there exists a "mixing effect" during reorientation of the tubes from the horizontal position to the vertical position during deceleration, which also increases with the steepness of the tubes within the rotor. During sedimentation, particles travel outward from the axis of rotation until they hit the wall of the tube, then slide downward along the tube wall. This descending layer of increased particle concentration combined with a corresponding ascending layer of reduced concentration fluid creates a fluid flow within the tube which increases the time required to sediment particles, particularly those of low density or irregular shape.

A final disadvantage of using steeply angled tube cavity rotors is that as the steepness of the tube increases, the capacity of the tube decreases. Since the closure of these tubes can trap particles, there is a limit to the tube angle that can be used during centrifugation.

Advances in the speed of test instrumentation have created a demand for faster blood separation methods, and particularly for high speed separation of the blood or serum within the original blood collection tube while maintaining a minimal distortion of the separation boundary within the sample containers.

SUMMARY OF THE INVENTION

A high efficiency centrifuge rotor, rotatable about a central axis of rotation, is provided having a plurality of cavities disposed at a compound angle. The first angle of the compound angle is with respect to the central axis of rotation, and the second angle of the compound angle is with respect to an axis perpendicular to the central axis of rotation.

With this arrangement, a high efficiency centrifuge rotor for rapid separation of particles suspended in a liquid is provided. The rotor allows for faster and sharper separation while minimizing distortion of the separation boundary within the sample containers.

BRIEF DESCRIPTION OF THE DRAWINGS

The invention will be more fully understood from the following detailed description taken in conjunction with the accompanying drawings in which.

DESCRIPTION OF THE PREFERRED EMBODIMENT

Figure 1:
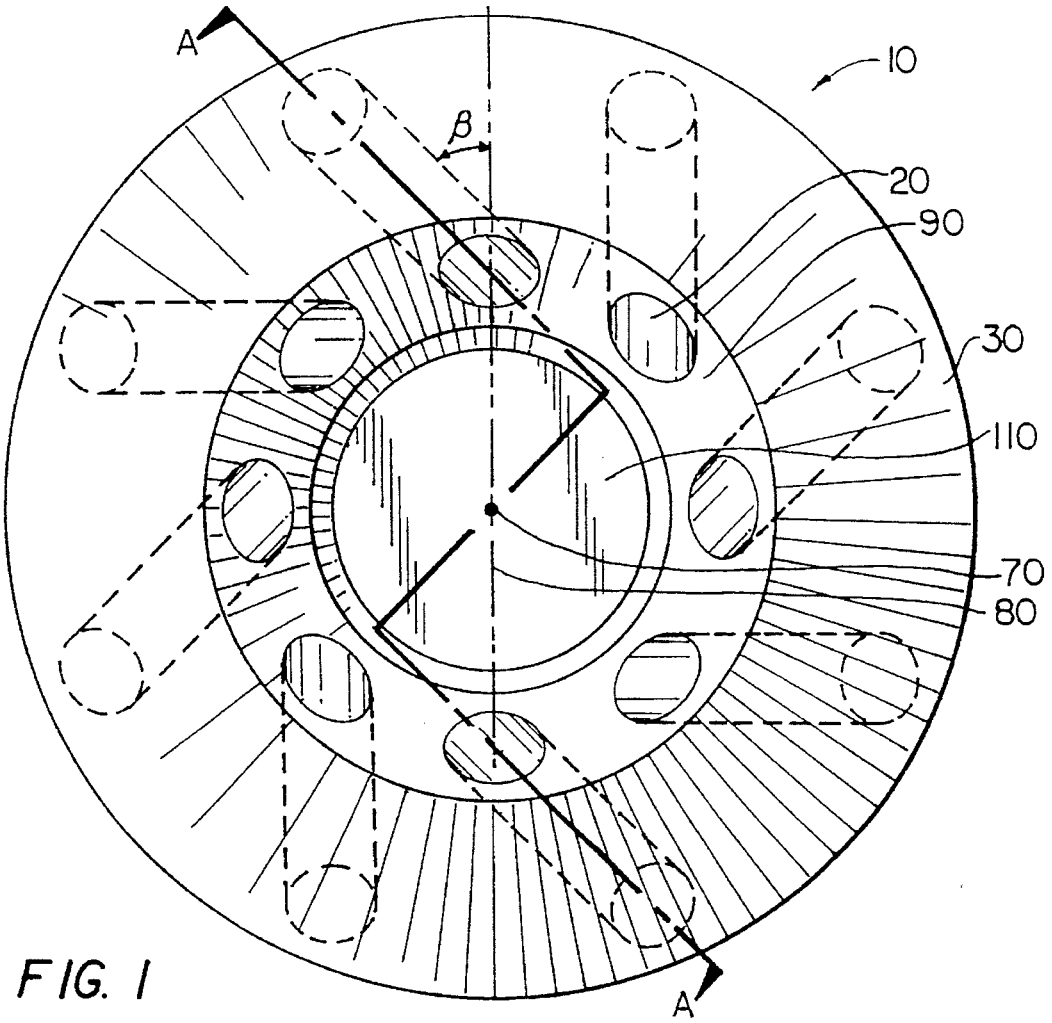
FIG. 1 is a top view of a rotor having eight cavities angled in accordance with one embodiment of the invention.

Referring to FIGS. 1 through 4, centrifuge rotors according to the present invention are shown. The rotor 10 is rotatable about a central axis 70. The rotor 10 has a number of cavities 20 disposed therein for support of sample containers, such as evacuated tubes which are commonly used in blood collection. The rotor 10 has a truncated conical shape, including a top surface 90 cooperative with the open ends of the cavities 20. The rotor has a central depression 110 for mating with a shaft 140, (shown in FIG. 6) within a spinner, as described below in conjunction with FIG. 6.

In the illustrative embodiment, the cavities 20 are spaced symmetrically and equidistantly away from each other within the rotor body 10. The cavities are positioned at a fixed compound angle with a first angle α of the compound angle taken with respect to the central axis of rotation 70 and the second angle β of the compound angle taken with respect to an axis 80 extending radially from the central axis of rotation (i.e., perpendicular to the central axis of rotation).

The first angle α of the cavity with respect to the axis of rotation 70 through the center of the rotor 10 is selected to be large enough to provide a reduced separation boundary size, while not being so large as to provide for a large K-factor. The angle α is between approximately 10° and 80° with the open end of the cavity being closer to the center of rotation than the bottom end of the cavity. That is, the cavity 20 is angled towards the central axis of rotation 70. In a particular embodiment, the cavities 20 are at a fixed first angle α of approximately 30° with respect to the central axis of rotation 70.

The angle β (FIG. 1) of the compound angle at which the cavities are disposed is with respect to an axis 80 extending radially from the center of rotation (i.e. perpendicular to the central axis of rotation 70). Preferably the second angle is between approximately 10 and 80°. In the illustrative embodiment the second angle β is also fixed at approximately 30°. As described in detail below, the positioning of the cavities at a compound angle provide the benefits associated with smaller angles of inclination (greater separation efficiency) as well as the benefits associated with larger angles of inclination (reduced separation boundary size).

Figure 1A:
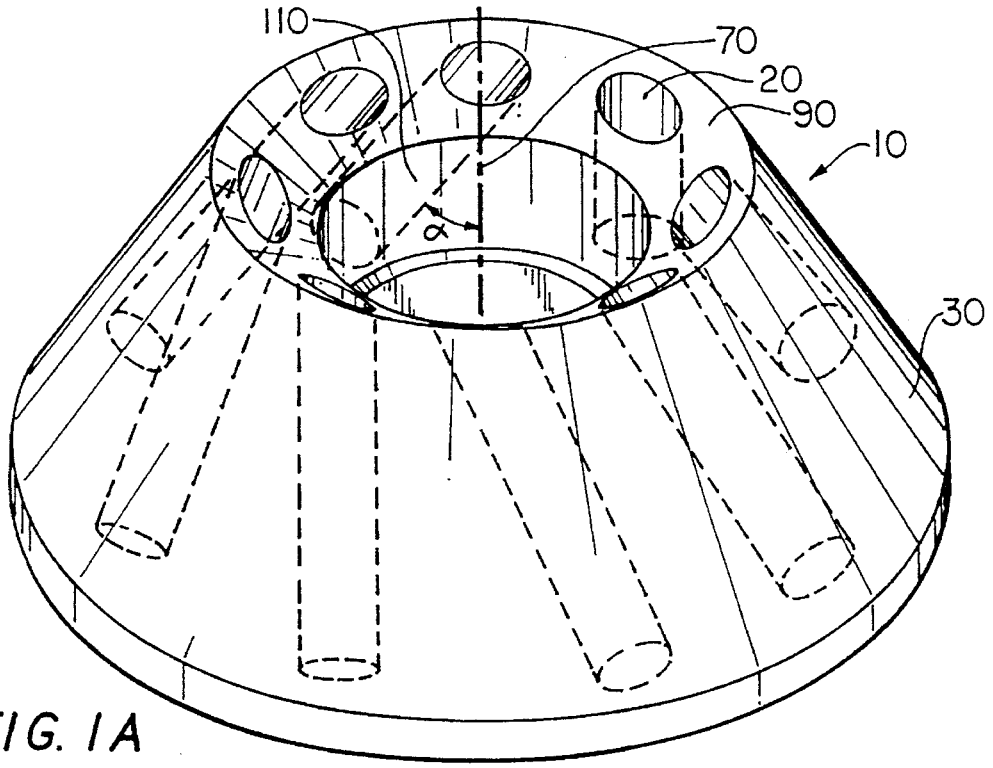
FIG. 1A is an isometric view of the rotor of FIG. 1.

The compound angle at which the tube cavities 20 are oriented in FIGS. 1 and 1A is such that the respective bottoms of the tubes trail the respective tops of the tubes during clockwise rotation of the rotor. This allows the rotor to take advantage of the Coriolis effect. The Coriolis effect occurs in a centrifugal field, and describes the movement of particles as they travel outward from the center of rotation. During centrifugation, particles do not travel in a perfectly straight line radially outward from the center of rotation, but rather travel in a curved path, away from the direction of rotation. By orienting the tube cavities such that the bottom of the tubes trail the top of the respective tubes while being rotated, the curved path of the particles from the center of rotation due to the Coriolis effect are in the same direction as the particles being centrifuged, and the separation of particles from the suspension is enhanced.

Figure 2:
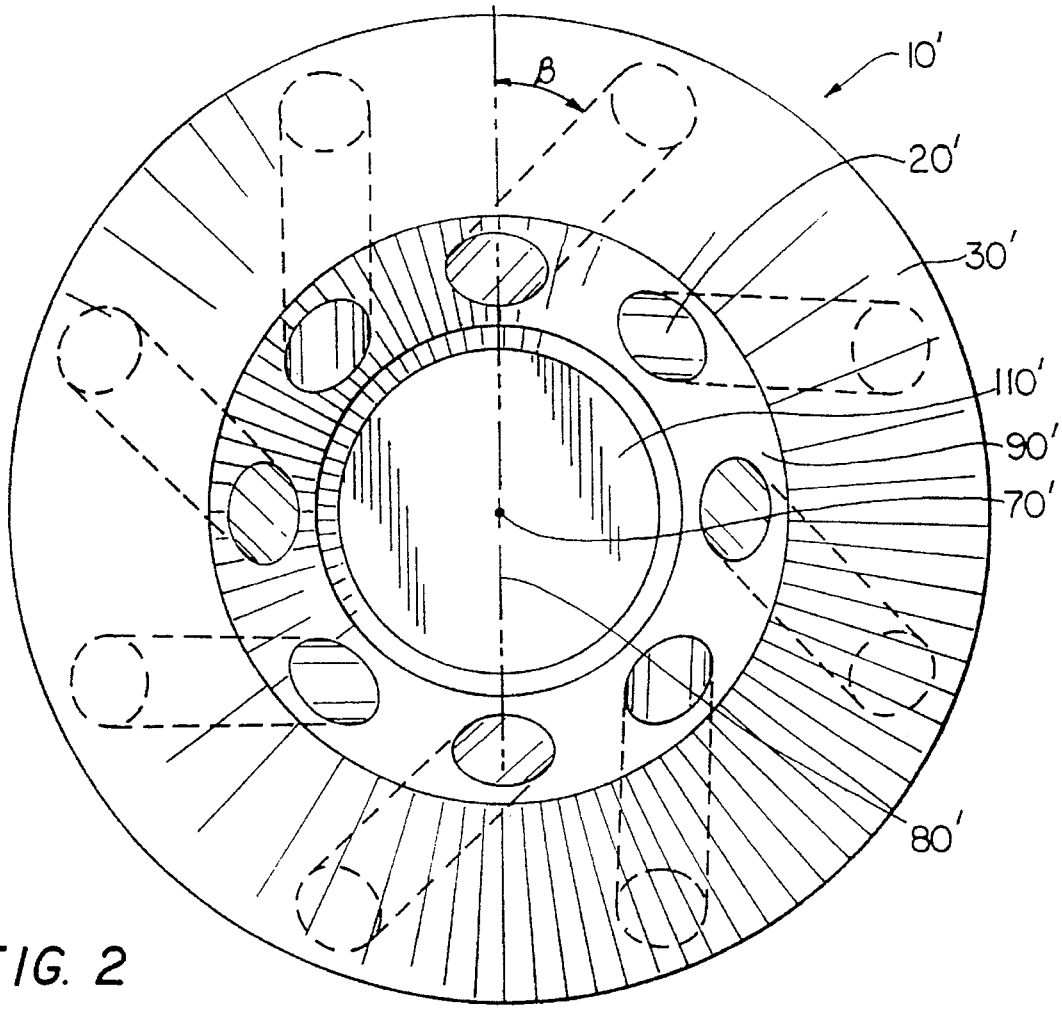
FIG. 2 is a top view of a rotor having eight cavities angled in accordance with an alternate embodiment of the invention.
Figure 2A:
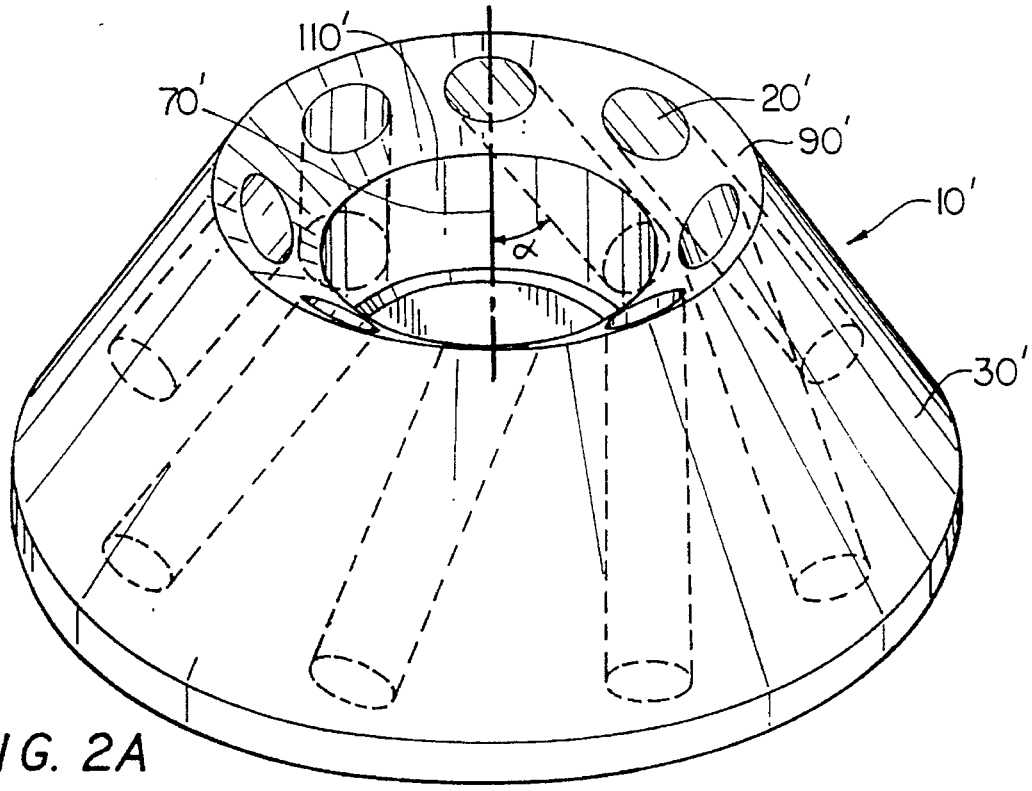
FIG. 2A is an isometric view of the rotor of FIG. 2.

Referring also to FIGS. 2 and 2A an alternative embodiment of the rotor includes tube cavities 20' oriented such that the bottoms of the tubes lead the tops of the respective tubes during clockwise rotation of the rotor 10'.

Figure 3:
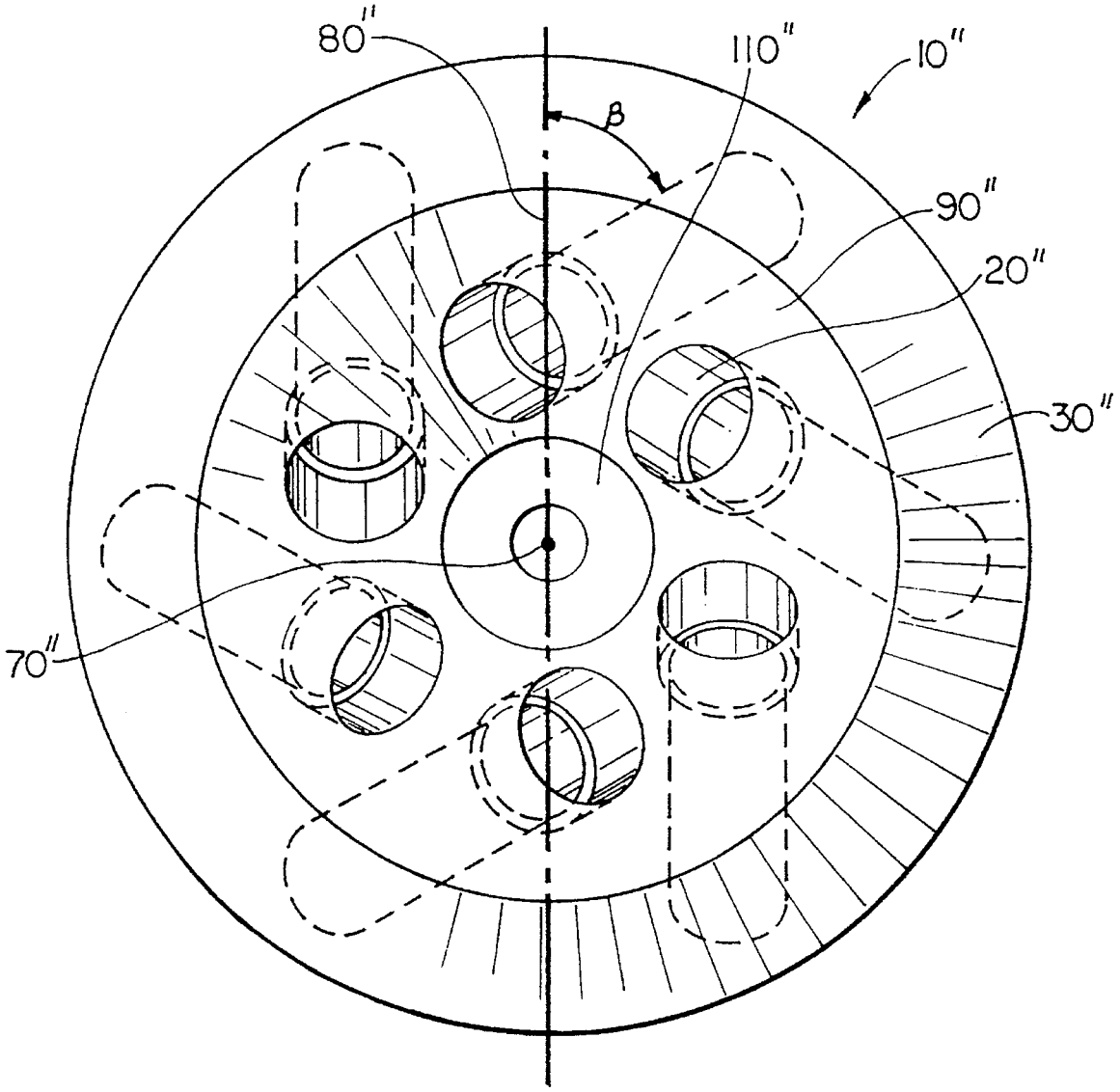
FIG. 3 is a top view of a rotor having six cavities angled in accordance with one embodiment of the invention.
Figure 4:
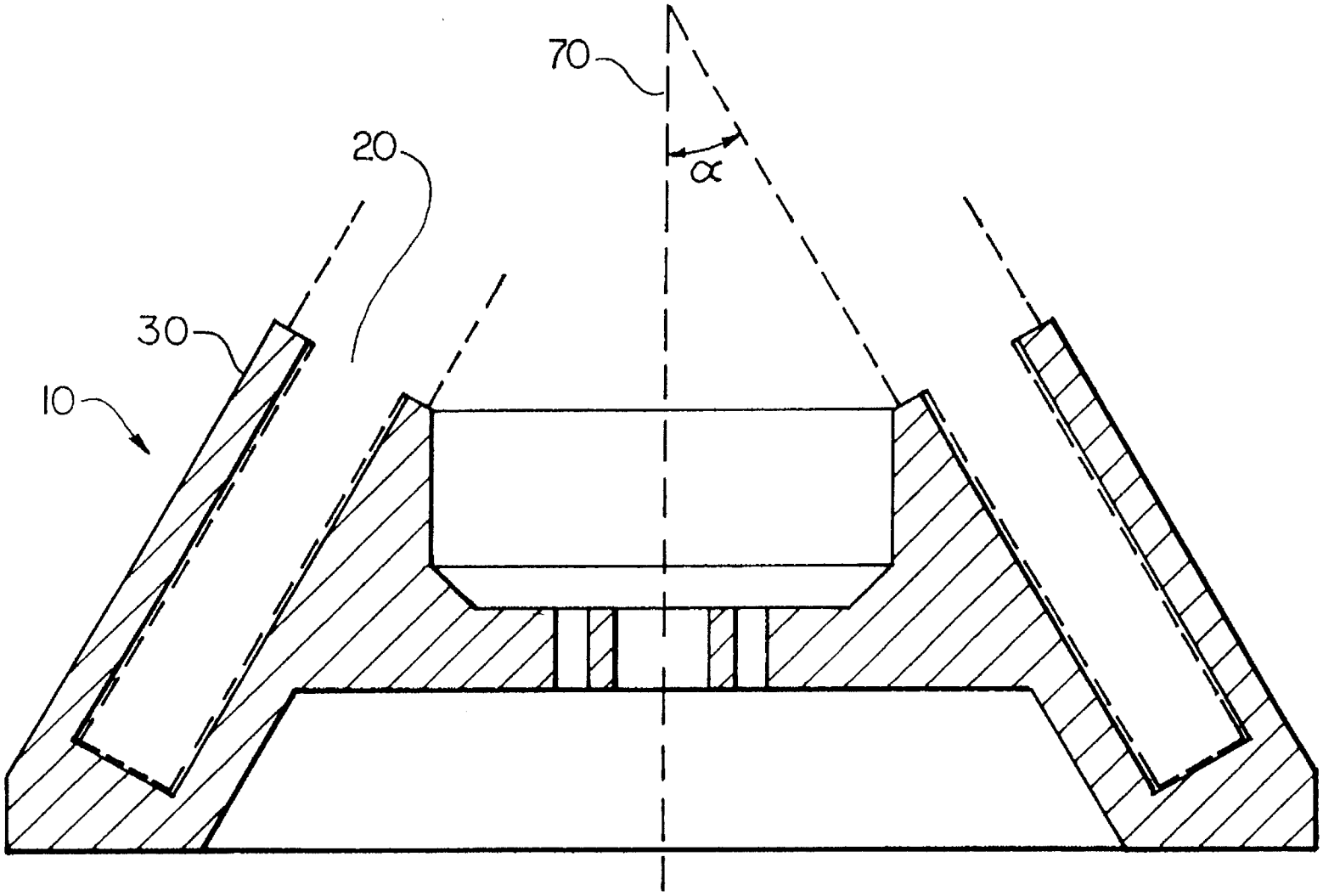
FIG. 4 is a cross-sectional view of the rotor of FIG. 1A taken along the line A—A in FIG. 1A.

FIG. 3 shows an alternate embodiment in which six cavities are spaced symmetrically and equidistantly away from each other. In this embodiment the bottoms of the tubes lead the tops of the respective tubes during clockwise rotation of the rotor 10", though another embodiment could have the six cavities oriented such that the respective bottoms of the tubes trail the respective tops of the tubes. While rotors including six or eight cavities are shown, any number of cavities could be disposed within the rotor.

Figure 5:
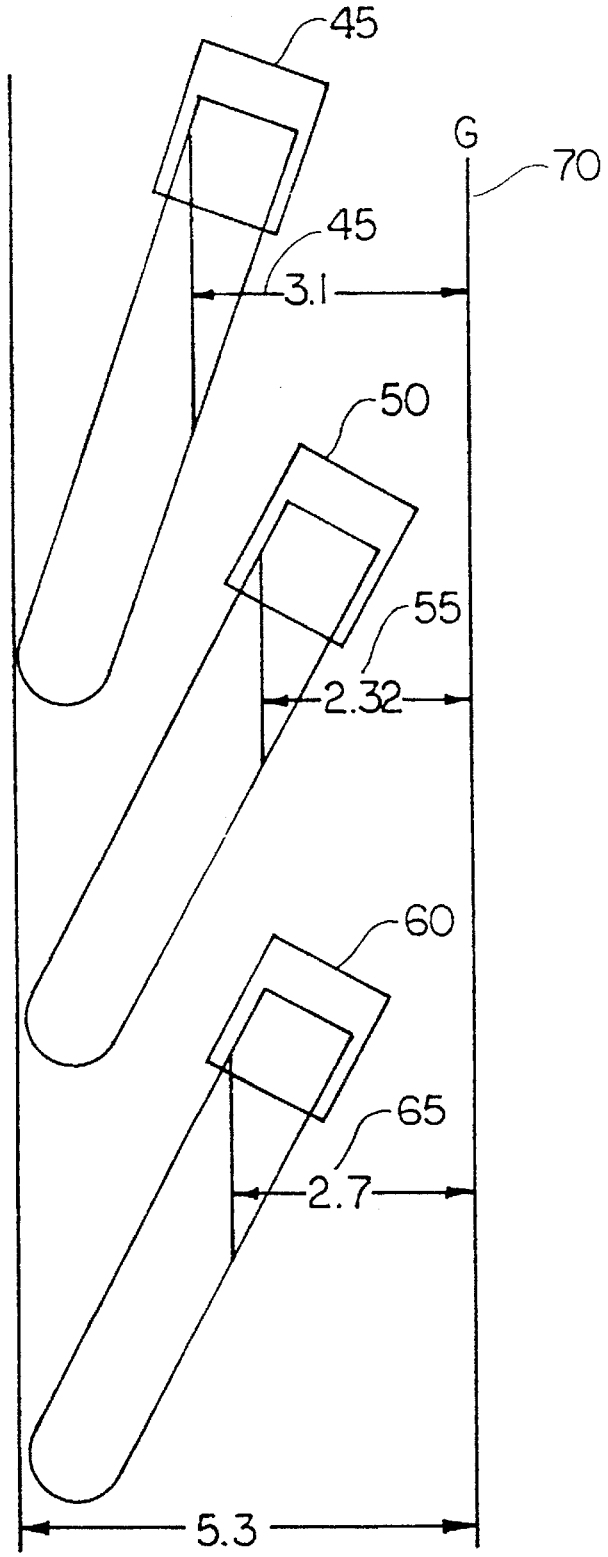
FIG. 5 is a diagram showing the relative positioning of 3 sample containers at different angles.

Referring now to FIG. 5, an evacuated tube 40 is shown at a fixed angle of approximately 20° relative to vertical. Operation of a rotor having cavities for holding evacuated tubes disposed at this angle provides for a rapid separation of blood (low K-factor), but also results in a large separation barrier. This is an undesirable effect, and particularly so when a gel tube is used, in which case the sedimented material is loosely packed and may be easily disrupted, or when processing of the separated sample involves the insertion of a canula into the tube to draw off the supernatant.

Evacuated tube 50 is disposed at a fixed 30° angle and provides for a reduced separation barrier. However, there is a concomitant reduction in the efficiency of the separation (higher K-factor) results with the tube 50.

In accordance with the invention, evacuated tube 60 is shown disposed at a compound angle, with the first angle α of approximately 30° being with respect to the axis of rotation 70, and the second angle β, also of approximately 30° being with respect to an axis extending radially from the center of rotation. Accordingly, this implementation provides a reduced separation boundary equivalent to that of tube 50, and less than that of 40.

Additionally, the K-factor of the tube 60 disposed at a compound angle is better than that of tube 50 and close to that of tube 40. The $r_2$ (radius from the center of the top of the liquid within the tube to the central axis of rotation) 45 of tube 40 results in the low K-factor for tube 40. Correspondingly, the smaller $r_2$ 55 of tube 50 results in the increased K-factor of tube 50. For tube 60, the $r_2$ 65 value is larger than the $r_2$ value 55 of tube 50, and thus results in a lower K-factor, while maintaining the reduced separation barrier provided by 30° inclination. Using the K-factor formula:

$$K\text{-factor} = \frac{2.53 \times 10^{11} \times \mathrm{Ln}\left(\frac{r_1}{r_2}\right)}{N^2}$$

for the three types of tube angles as shown in FIG. 5 provides the following results:

For the 20° tube 40 having an $r_2$ 45 of 3.1 cm, an $r_1$ 47 of 5.3 cm and a rotational speed of 7,500 rpm the resulting K-factor is 2,412.

For the 30° tube 50 having an $r_2$ 55 of 2.3 cm, an $r_1$ 57 of 5.3 cm and a rotational speed of 7,500 rpm the resulting K-factor is 3,754.

For the tube 60 at a compound angle of the present application having an $r_2$ 65 of 2.7 cm, an $r_1$ 67 of 5.3 cm and a rotational speed of 7,500 rpm the resulting K-factor is 3,033.

By having both angles α and β of the compound angle at 30° , an ideal balance between separation efficiency and separation barrier distortion for standard 7–10 mL blood collection tubes which do not include leak proof closures has been provided. By disposing the tube at a compound angle, the present application provides a rotor that maintains the reduced separation barrier of rotors having tubes at a fixed 30° angle of inclination, while maintaining a low K-factor closer to that exhibited by rotors having tubes at a fixed 20° angle of inclination.

Other implementations could have the first angle α and second angle β at any angle from approximately 10° –80° dependent upon the volume of the containers being centrifuged, and the material being centrifuged. Also, the first angle α and the second angle β do not have to be the same value. For example, one could have a rotor having the cavities disposed at a compound angle in which the first angle α is at 20° and the second angle β at 40°.

An additional benefit from orienting the tube cavities at a compound angle is that the rotor has a lower profile, which in turn reduces the complexity of the centrifuge.

Figure 6:
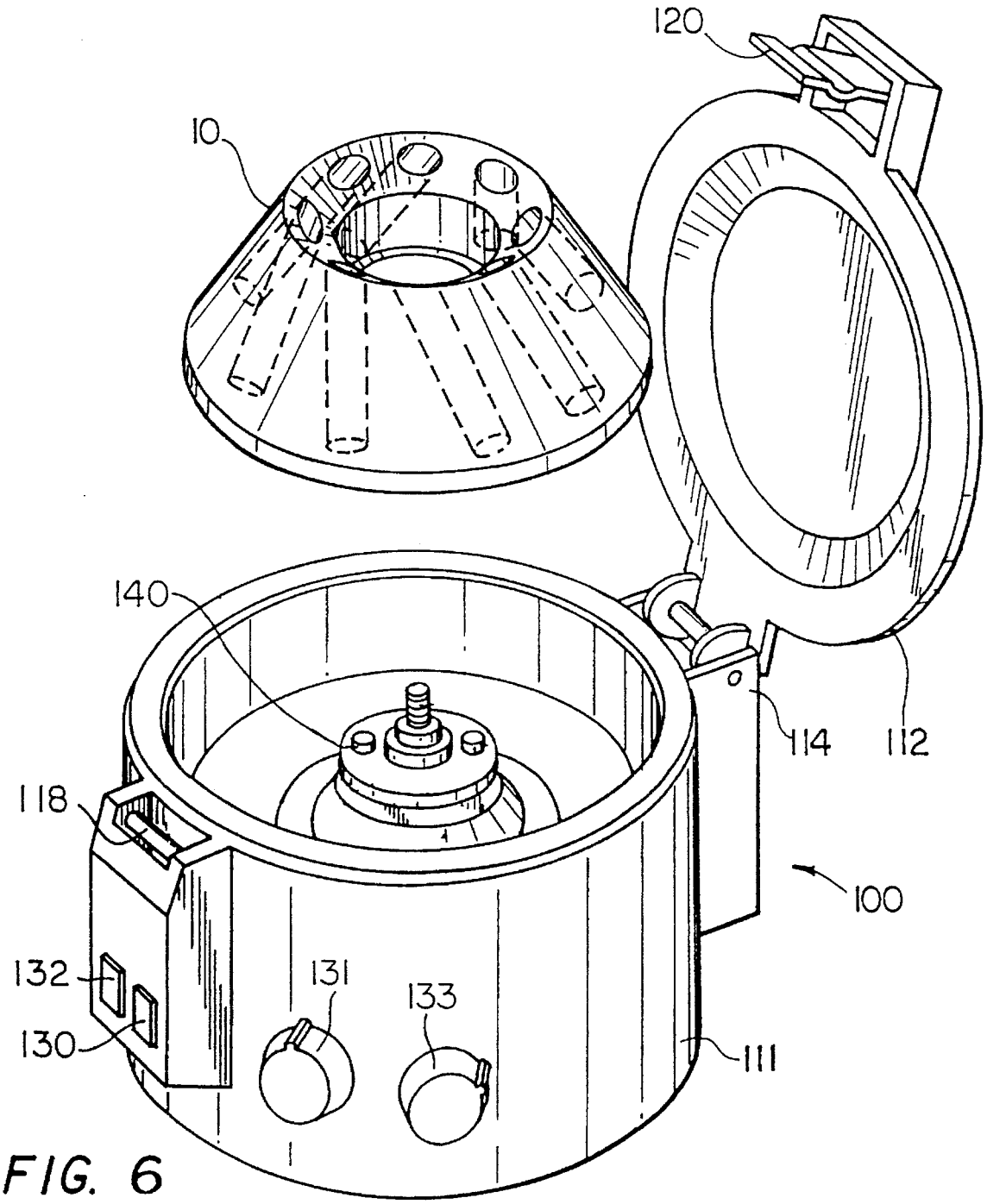
FIG. 6 is an exploded view of a centrifuge including the rotor of FIG. 1A.

FIG. 6 shows a typical centrifuge 100 suitable for rotating the high efficiency rotor 10. The rotor 10 is coupled to shaft 140, thereby causing the rotor 10 to rotate when the centrifuge 100 is turned on. The centrifuge 100 includes a centrifuge body 111. A lid 112 is mounted to hinge 114 which movably connects the lid 112 with the body 111. The hinge 114 allows the lid 112 to move between two positions, an open position (as shown) which allows access to the rotor 10, and a closed position in which the lid covers the top of centrifuge body 111. The lid 112 includes a latch mechanism 120 which secures the lid in a closed position over body 111 when the latch mechanism 120 is mated against latch pin 118. Centrifuge 100 also includes a speed control 131 for setting the rotational speed of the high efficiency rotor 10 within centrifuge 100. Time control 133 sets the amount of time that the rotor 10 will be rotated. Switch 132 is the START switch which, when activated, allows the centrifuge 100 to rotate rotor 10 within centrifuge body 111. Switch 130 is the STOP switch which stops the power to the motor. Switch 130 is usually not used, since the centrifuge cycle is timed.

A rotor according to the present invention has applications including: processing of primary blood collection tubes for coagulation testing and generation of plasma, processing of coagulated blood to produce serum, the processing of specialized blood collection tubes, and the production of platelet-rich-plasma for platelet studies. The present invention may also be used in other applications involving containers of liquid having particles suspended therein, such as to reduce the processing time for sedimentation of subcellular fractions, provide density gradient separations, and for routine cell separations. The cavities can support tubes, bottles, bags and other various types of containers, all of which may be either open or closed during the centrifugation.

Another application for the invention is in centrifugal vacuum concentrators. There it is desired to have the largest possible top surface area of a fluid in the spun tubes in order to enhance evaporation. By increasing the β or second angle toward 80°, the free surface is significantly increased over a conventional fixed angle rotor.

Having described preferred embodiments of the invention it will now become apparent to those of ordinary skill in the art that other embodiments incorporating these concepts may be used. Accordingly, it is submitted that the invention should not be limited to the described embodiments but rather should be limited only by the spirit and scope of the appended claims.

I claim:

1. A centrifuge rotor comprising:

a rotor body rotatable about a central axis of rotation having a plurality of tubular cavities open at a first end at a top surface of said rotor body, said tubular cavities disposed at a compound angle comprising a first angle with respect to said central axis of rotation and a second angle with respect to an axis perpendicular to said central axis of rotation.

2. The rotor of claim 1 wherein said tubular cavities are symmetrically and equidistantly spaced from each other within said rotor body.

3. The rotor of claim 1 wherein said tubular cavities are disposed at said second angle of said compound angle such that a bottom end of each of said tubular cavities trails said respective first end of said tubular cavity during rotation of said rotor.

4. The rotor of claim 1 wherein said tubular cavities are disposed at said second angle of said compound angle such that each of said first ends of said tubular cavities trails a respective bottom end of said tubular cavity during rotation of said rotor.

5. The rotor of claim 1 wherein said first angle of said compound angle is between approximately 10°–80°.

6. The rotor of claim 5 wherein said first angle is approximately 30°.

7. The rotor of claim 1 wherein said second angle of said compound angle is between approximately 10°–80°.

8. The rotor of claim 7 wherein said second angle is approximately 30°.

9. The rotor of claim 1 wherein said plurality of cavities comprises six cavities.

10. The rotor of claim 1 wherein said plurality of cavities comprises eight cavities.

11. The rotor of claim 1 wherein said cavities support containers adapted for having a liquid containing suspended particles disposed therein.

12. The rotor of claim 11 wherein said containers comprise evacuated tubes.

13. The rotor of claim 11 wherein said containers comprise bottles.

14. The rotor of claim 11 wherein said containers comprise bags.

15. The rotor of claim 11 wherein said containers are open.

16. The rotor of claim 11 wherein said containers are closed.

17. Centrifuge apparatus comprising:

a spinner; and a rotor body rotatable about a central axis of rotation by said spinner, said rotor body having a plurality of tubular cavities open at a first end at a top surface of said rotor body, said tubular cavities disposed at a compound angle comprising a first angle with respect to said central axis of rotation and a second angle with respect to an axis perpendicular to said central axis of rotation.

* * * * *